US008517785B2

(12) United States Patent
Danov et al.

(10) Patent No.: US 8,517,785 B2
(45) Date of Patent: Aug. 27, 2013

(54) VESSEL PROPULSION SYSTEM FOR WATERCRAFT

(75) Inventors: Vladimir Danov, Erlangen (DE); Andreas Schröter, Anrode/Bieckenriede (DE)

(73) Assignee: Siemens Aktiengesellschaft, Munich (DE)

( * ) Notice: Subject to any disclaimer, the term of this patent is extended or adjusted under 35 U.S.C. 154(b) by 245 days.

(21) Appl. No.: 13/062,835

(22) PCT Filed: Jul. 17, 2009

(86) PCT No.: PCT/EP2009/059223

§ 371 (c)(1),
(2), (4) Date: Mar. 8, 2011

(87) PCT Pub. No.: WO2010/025987

PCT Pub. Date: Mar. 11, 2010

(65) Prior Publication Data

US 2011/0165802 A1 Jul. 7, 2011

(30) Foreign Application Priority Data

Sep. 8, 2008 (DE) ..... 10 2008 046 292

(51) Int. Cl.
*B63H 21/14* (2006.01)

(52) U.S. Cl.
USPC ..... 440/88 C; 440/6

(58) Field of Classification Search
USPC ..... 440/6, 88 C
See application file for complete search history.

(56) References Cited

U.S. PATENT DOCUMENTS

| | | | | |
|---|---|---|---|---|
| 6,231,407 | B1 | 5/2001 | Hein et al. | |
| 6,312,298 | B1 | 11/2001 | Schüring | |
| 6,485,339 | B1 | 11/2002 | Hartig et al. | |
| 6,994,602 | B2 * | 2/2006 | Ries | 440/6 |
| 7,018,249 | B2 | 3/2006 | Ries et al. | |
| 7,061,147 | B2 | 6/2006 | Ries | |
| 7,448,929 | B2 * | 11/2008 | Huber et al. | 440/88 C |
| 7,569,954 | B2 | 8/2009 | Tölle et al. | |
| 2004/0248479 | A1 | 12/2004 | Hein et al. | |
| 2008/0287016 | A1 | 11/2008 | Grimmeisen | |

FOREIGN PATENT DOCUMENTS

| | | | |
|---|---|---|---|
| DE | 19627323 | A1 | 1/1998 |
| DE | 19648417 | A1 | 5/1998 |

(Continued)

OTHER PUBLICATIONS

H. Mrugowsky "Moderne elektrische Schiffsantriebe", Rostock, 2001, pp. 63-66, Book, 2001—Statement of Relevance.

*Primary Examiner* — Lars A Olson
(74) *Attorney, Agent, or Firm* — Laurence A. Greenberg; Werner H. Stemer; Ralph E. Locher

(57) ABSTRACT

A ship propulsion system for watercraft contains at least one propeller, by which a drive force can be created for the watercraft. The ship propulsion further contains an electric motor, the rotor of which is directly mechanically coupled to the at least one propeller via a shaft such that the at least one propeller may be brought into a respective rotating movement by a rotation of the rotor. In order to cool the rotor of the electric motor a thermosiphon is disposed in the shaft, and the propeller serves as a heat sink for a working medium of the thermosiphon.

18 Claims, 1 Drawing Sheet

(56) References Cited

FOREIGN PATENT DOCUMENTS

| | | | |
|---|---|---|---|
| DE | 10000578 | A1 | 7/2001 |
| DE | 102004040493 | A1 | 3/2006 |
| DE | 102004049615 | A1 | 4/2006 |
| DE | 102007043656 | A1 | 5/2009 |
| WO | 9905023 | A1 | 2/1999 |
| WO | 9936312 | A2 | 7/1999 |
| WO | 03023941 | A1 | 3/2003 |
| WO | 03047961 | A2 | 6/2003 |
| WO | 2004030182 | A1 | 4/2004 |
| WO | 2005112237 | A1 | 11/2005 |

* cited by examiner

VESSEL PROPULSION SYSTEM FOR WATERCRAFT

BACKGROUND OF THE INVENTION

Field of the Invention

The invention relates to a vessel propulsion system for watercraft which comprises at least one vessel propeller with which a drive force for the watercraft can be generated. The vessel propeller is driven by means of an electric motor, of which the rotor is mechanically coupled directly to the at least one vessel propeller by means of a shaft, so that the at least one vessel propeller can be made to perform a corresponding rotation movement as a result of rotation of the rotor.

Direct connection of the electric motor to the vessel propeller is to be understood to mean a gear-less connection technique within the scope of the present description. The change in the rotation speed of the vessel propeller is caused solely by the change in the motor rotation speed. An embodiment of this kind has the advantage that a gear mechanism is not required between the motor and the vessel propeller and the required drive motors for the vessel propeller do not always have to run at full rotation speed if this is not required at the vessel propeller. Efficient and powerful electric motors with a high power density are required in order to realize vessel propulsion systems of this kind. Care should be taken here that the high power density of the drive motor is not achieved at the cost of poorer efficiency or a shorter service life.

The publication "Moderne elektrische Schiffsantriebe [Modern electric vessel propulsion systems]" by H. Mrugowsky, 10th Symposium on Maritime Electronics, Rostock, 2001, Tagungsband Arbeitskreis Energie- und Steuerungstechnik [Energy and control engineering working group seminar volume], pages 63 to 66, discloses a vessel propulsion system of the type described above. The vessel propulsion system is in the form of a pod drive. A pod drive of this kind has improved maneuvering characteristics for large ocean-going vessels. In this case, the electric motor for driving the vessel propeller is accommodated in a pod which is arranged in a rotatable manner beneath the stern of the vessel, with the electric motor being fed via flexible feed lines or slip rings. In order to improve the degree of efficiency with a relatively low degree of cavitation and noise formation, said publication proposes providing two propellers on the pod, said propellers being arranged one behind the other and operating in the opposite direction in relation to the swirl effect. In one variant, a synchronous motor with permanent-magnet excitation which is accommodated in the pod drives the two vessel propellers of opposing gradient. Another variant proposes providing a machine cascade comprising an asynchronous machine and a rotatably mounted synchronous machine in the pod in order to design the vessel propellers, which are situated one behind the other, in an optimum manner. In this case, the rotor of the asynchronous motor is firmly connected to the rear vessel propeller and to the armature of the synchronous machine; however, the rotor of the synchronous machine, which rotor is fitted with the pole system, is connected to the front vessel propeller. This is schematically illustrated in FIG. 3 of the publication.

BRIEF SUMMARY OF THE INVENTION

The object of the present invention is therefore to specify a vessel propulsion system in which electric motors which have a high power density and a high degree of efficiency and a long service life can be used.

A vessel propulsion system according to the invention for watercraft comprises at least one vessel propeller with which a drive force for the watercraft can be generated. The vessel propulsion system also comprises an electric motor, of which the rotor is mechanically coupled directly to the at least one vessel propeller by means of a shaft, so that the at least one vessel propeller can be made to perform a corresponding rotation movement as a result of rotation of the rotor. The vessel propulsion system is distinguished in that a thermosiphon, which is arranged in the shaft, is provided for the purpose of cooling the rotor of the electric motor, with the vessel propeller serving as a heat sink for a working medium of the thermosiphon.

The invention makes use of the fact that cooling of the rotor leads to an increase in efficiency in electric motors. In the case of the vessel propulsion system according to the invention, the electric motor is cooled by a thermosiphon in the rotor shaft. The rotor of the electric motor is also cooled by the shaft being cooled, as a result of which the desired increase in the degree of efficiency of the propulsion system is achieved. The heat which is dissipated by the rotor is transmitted to the vessel propeller, which is in the water, via the thermosiphon, and therefore the vessel propeller serves or is designed as a condenser.

The components which are required for cooling purposes do not require servicing and can always be used in locations in which an electric motor is connected directly to a vessel propeller in the case of a vessel propulsion system. This is generally the case in the pod drive concepts already mentioned above, submarine propulsions systems etc. The vessel propeller, which is arranged in its cooling medium, provides excellent heat dissipation. Furthermore, the advantage of a reduced winding temperature is provided, and therefore lower-cost cast resins with a lower temperature class can be used for the windings. As a result, the costs of the vessel propulsion system can be reduced.

According to one advantageous refinement, a recess, which extends in the longitudinal direction, is provided for the purpose of forming the thermosiphon in the shaft, it being possible for the working medium to circulate in said recess on account of a change in the state of aggregation between liquid and gaseous. It is expedient here for the recess to extend over the entire width of the rotor of the electric motor, so that heat can be passed to the working medium in the thermosiphon as effectively as possible. Furthermore, it is also advantageous for the recess to be formed in the region of bearing points of the electric motor. In addition to cooling the rotor, bearing temperatures at the bearing points of the drive train are also equalized and reduced, as a result of which the service life of these parts, which are subject to high levels of wear, is extended.

In one refinement, the shaft has a central section and at least one end section, which is firmly connected to the central section and to which the at least one vessel propeller is attached, with the recess in the central section being of cylindrical design and the recess in the at least one end section being of conical design. This refinement ensures circulation of the working medium which has different states of aggregation during operation of the vessel propulsion system. In contrast to conventional thermosiphons, circulation of the working medium in the recess is made possible not by capillary forces, but rather by rotational forces. To this end, the conical shape of the recess in the at least one end section of the shaft is required in order to push condensed working medium back in the direction of the rotor of the electric motor.

One specific refinement makes provision for the electric motor and at least a portion of a central section of the shaft to be arranged in a fluid-tight manner in a housing part, in particular a housing pod, with the at least one end section being formed outside the housing part. It goes without saying that appropriate sealing means are provided in the region in which the shaft passes through the housing part, in order to prevent the ingress of water into the interior of the housing part in which electrical components are provided.

According to a further refinement, an apparatus having spokes which extend radially from a central hub is provided in the conical recess of the at least one end section, in order to improve the formation of a condensate film of the working medium on the conical wall of the end section. The apparatus is preferably arranged in the conical recess and is intended to improve circulation of the working medium in the thermosiphon.

It is also expedient for the diameter of the recess, in particular in the central section, to have a ratio relative to the diameter of the shaft such that at least one prespecified torque can be transmitted to the at least one vessel propeller. The provision of a recess in the shaft reduces the torque which can be transmitted to the impeller by the electric motor. Care should therefore be taken when structurally designing the thermosiphon that a minimum requisite torque can still be transmitted from the shaft to the at least one vessel propeller. The provision of the thermosiphon in the shaft may lead to the diameter of the shaft having to be increased in order to be able to satisfy the required operating parameters of the vessel propulsion system.

It has also been found that the efficiency of the thermosiphon is particularly high when the wall of the recess is rough. This means that it is not necessary to refinish the walls in any particular way, particularly when making the recesses in the central section and the at least one end section of the shaft. Rather, it has been found that the efficiency of the thermosiphon is greatest when no further processing steps are performed on the recess after the recess is made. In addition to a maximum increase in the degree of efficiency, this keeps the costs of production of the thermosiphon low.

It is also expedient for the working medium to be inserted into the recess under vacuum and to be permanently arranged in the recess without loss by virtue of the provision of sealing means. The working medium provided is a refrigerant, in particular water, FC72, R124a, R600a, isobutane, etc., with an evaporation temperature of less than 100° C. A suitable working medium is, in principle, any refrigerant which has an evaporation temperature which is lower than the heat which is generated by the rotor of the electric motor.

According to a further refinement, the electric motor is arranged in a pod, with the pod being mechanically connected to a hull of the watercraft, and in particular such that it can be rotated in relation to the hull. This provides a considerably improved maneuvering characteristic for large ocean-going vessels.

In order to further improve the degree of efficiency with relatively low degrees of cavitation and noise formation, in each case one of the end sections is provided at the two opposite ends of the shaft, in each case one vessel propeller being arranged at said end sections. It is expedient here for the two vessel propellers, which are arranged on the shaft, to be designed in such a way that they are in the form of propellers which operate in the opposite direction in relation to the swirl effect.

In a further expedient refinement, each of the vessel propellers has an associated electric motor, with the electric motors acting, in particular, on a common shaft. In this case, provision may further be made for thermosiphons which are functionally separate from one another to be provided in the common shaft, said thermosiphons in each case being associated with one of the electric motors. If the vessel propulsion system has only one electric motor but two vessel propellers at opposite ends of the shaft, provision can likewise be made for thermosiphons which are functionally separate from one another to be provided in the common shaft.

The invention will be explained in greater detail below with reference to exemplary embodiments in the drawing, in which:

DESCRIPTION OF THE INVENTION

Figure 1:
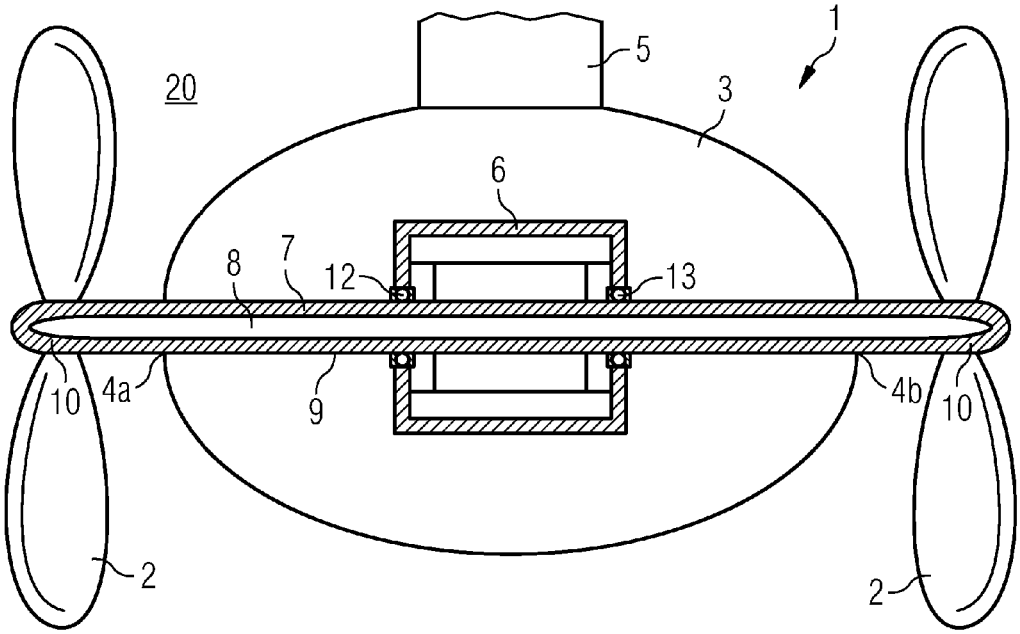
FIG. 1 shows a schematic illustration of a first exemplary embodiment of a vessel propulsion system according to the invention having an electric motor.

FIG. 1 shows a schematic illustration of a first exemplary embodiment of a vessel propulsion system 1 according to the invention. The vessel propulsion system 1 is in the form of a pod drive in which an electric motor 6, which is connected to a shaft 7, is arranged in the interior of a housing part 3 which is in the form of a pod. The electric motor 6 can, in principle, be realized in any desired manner. In particular, the electric motor 6 can be in the form of an asynchronous machine, a synchronous machine or a machine with permanent-magnet excitation. The pod 3 is connected to the hull of a vessel (not illustrated) by means of a pod neck 5. A pod drive of this kind permits improved maneuvering characteristics, in particular for large vessels.

In the present exemplary embodiment, the shaft 7, which is mechanically connected to a rotor of the electric motor 6, emerges from the pod at the two opposite ends of the pod 3 through respective passage openings 4*a*, 4*b*. In each case one vessel propeller 2 is arranged at the shaft stubs, with these vessel propellers preferably being in the form of propellers which operate in the opposite direction in relation to the swirl effect. The vessel propulsion system is called a "contrapod" on account of the vessel propellers 2, which are arranged opposite one another, in the water 20 around the pod 3.

In an alternative refinement, the vessel propulsion system could, in contrast to the drawing which is illustrated in FIG. 1, be provided only with a single vessel propeller 2, so that the shaft 7 emerges from the housing pod 3 only at one point.

For the purpose of increasing the degree of efficiency of the electric motor 6, a thermosiphon is formed in the shaft 7 in order to cool the rotor of the electric motor 6 and also bearing points 12, 13 for the shaft 7. To this end, the shaft 7 has a recess 8 which extends in the longitudinal direction (that is to say symmetrically to a rotation axis of the shaft 7). The recess 8 is designed in such a way that it is of cylindrical design in a central section 9 of the shaft 7, which runs substantially in the interior of the pod 3, and has a conical shape in the region of respective end sections 10. In this case, the central section 9 and the end sections 10, which are formed at the two opposite ends of the shaft 7, are firmly connected to one another. The vessel propellers 2, which are in the ocean water 20, serve as condensers for a working medium which is arranged in the interior of the recess 8. In order to be able to ensure circulation of the working medium on account of a change in the state of aggregation of said working medium between liquid and gaseous, the vessel propellers 2 are in each case connected to the end sections 10 of the shaft.

The central section 9 and the end sections 10 of the shaft 7 are connected to one another in such a way that the working medium, which is introduced into the recess 8 under vacuum, is permanently arranged in the recess without loss. The working medium provided in the recess 8 is a refrigerant which has an evaporation temperature of preferably less than 100° C. The refrigerant used can be, for example, water, R124a, R600a, FC72, isobutane and the like.

The provision of the recess 8 in the shaft 7 with the described shape in the central section 9 and the end sections 10 and the introduction of the refrigerant into the recess 8 create a thermosiphon which is arranged in the shaft 7 and in which the vessel propellers, which are connected to the shaft 7, serve as a heat sink for the refrigerant of the thermosiphon. Temperatures of approximately 150° C. to 300° C. are reached in the vicinity of the rotor, as a result of which the refrigerant, which is provided in the recess 8, begins to evaporate. On account of the substantially horizontal position of the shaft 7, the evaporated refrigerant is transported in the direction of the end sections 10 of the shaft 7 as a result of the rotation of the shaft 7. The vessel propellers 2 are arranged in the water, which is at 26 to 27° C., and therefore form a condenser of the thermosiphon. On account of the relatively low temperature of the vessel propellers 2 and the conical design of the recess 8 in the region of the end sections 10, the evaporated working medium condenses and is pushed against the wall of the conical recess in the end section 10 by virtue of the rotating shaft 7.

By virtue of the conical shape of the recess 8 in the region of the end sections 10, the condensed working medium is pushed in the direction of the central section 9 until it returns to the region of the hot electric motor 6 and is evaporated again there. The working medium circulates on account of the change in its state of aggregation between liquid and gaseous form in the recess 8 in the shaft 7. As a result, waste heat is transported away from the electric motor 6 and passed to the water 20 by means of the vessel propellers 2. The circulation of the working medium of the thermosiphon which is formed in the shaft 7 is based here, in contrast to conventional thermosiphons, not on capillary forces but rather on the rotational forces in the shaft 7 which are produced during operation.

As a result, this cools the rotor of the electric motor 6 and the bearing points 12, 13 of the shaft 7 in the region of the electric motor. This firstly increases the degree of efficiency of the electric motor 6. Secondly, the bearing temperatures at the bearing points 12, 13 of the drive train are equalized and reduced, as a result of which the service life of these parts, which are subject to a high level of wear, is extended.

By virtue of making the recess 8 in the shaft 7, the maximum torque which can be transmitted by the shaft 7 is reduced in relation to a solid shaft. The diameter of the recess 8, in particular in the central section 9, therefore has to be of a magnitude in relation the diameter of the shaft 7 such that at least one prespecified torque can be transmitted to the vessel propellers 2.

It is not necessary to refinish the surface of the wall of the recess during production of the recess 8 in the shaft. Instead, it has been found that the rougher the wall of the recess, the greater the efficiency of the thermosiphon. However, it is expedient to remove lubricants which may have been introduced into the recess for production of the recess 8, since said lubricants can adversely influence the state of aggregation of the working medium.

In the exemplary embodiment which is illustrated in FIG. 1, the recess 8 extends continuously between the shaft stubs. In an alternative refinement, two thermosiphons which are functionally separate from one another could also be provided in the shaft 7, since two recesses 8 with a respective central section 9 and a respective end section 10 are provided in the shaft 7. It is expedient here for the two recesses 8 to be spatially separated approximately in the center of the rotor of the electric motor 6, so that a sufficient amount of heat can be introduced into the recesses for evaporation of the respective working medium in each case.

Figure 2:
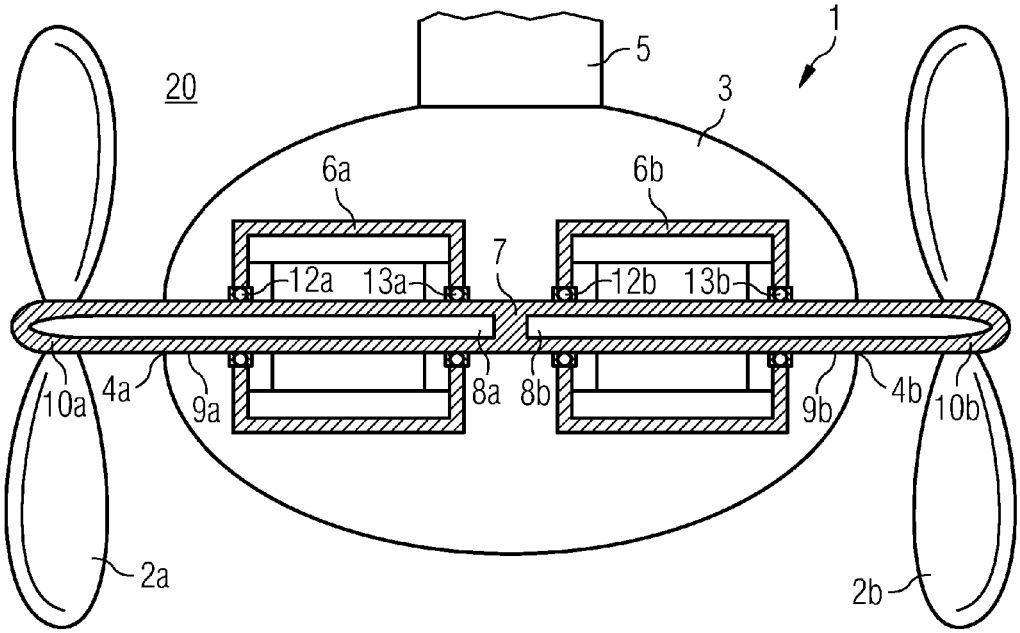
FIG. 2 shows a schematic illustration of a second exemplary embodiment of a vessel propulsion system according to the invention, in which two electric motors are provided for driving two vessel propellers.

FIG. 2 shows a schematic illustration of a further exemplary embodiment of a vessel propulsion system according to the invention. Said vessel propulsion system differs from the example which is shown in FIG. 1 in that two electric motors 6*a*, 6*b* are provided in the pod 3, said electric motors acting on the same shaft 7. The shaft 7 is mounted at bearing points 12*a*, 13*a* and 12*b*, 13*b* of the electric motors 6*a*, 6*b* and emerges at opposing passage openings 4*a*, 4*b*. In accordance with the exemplary embodiment in FIG. 1, the vessel propulsion system is in the form of a contrapod drive, in which two vessel propellers 2*a*, 2*b* are arranged at the opposite ends of the shaft 7 and therefore at the end sections 10*a*, 10*b* thereof. In contrast to the exemplary embodiment from FIG. 1, two thermosiphons, which are in each case associated with an electric motor 6*a*, 6*b*, are provided in this exemplary embodiment. The thermosiphons are thermodynamically separate from one another. Each thermosiphon therefore has in each case a recess 8*a* or 8*b* with in each case a central section 9*a* or 9*b* and an end section 10*a* or 10*b* which is connected to said central section and has a conical shape. As described above, the vessel propellers 2*a*, 2*b* are connected to the shaft 7 in the region of the end sections 10*a*, 10*b*.

The electric motors 6*a*, 6*b* which are arranged in the housing pod 3 can, for example, form a machine cascade which comprises, for example, an asynchronous machine (electric motor 6*a*) and a rotatably mounted synchronous machine (electric motor 6*b*). In this case, the rotor of the asynchronous motor 6*a* can be firmly connected to the vessel propeller 2*a* and to the armature of the synchronous machine, and the rotor, which is fitted with the pole system, of the synchronous machine 6*b* can be connected to the vessel propeller 2*b*. The component drives 6*a*, 6*b* are coupled both electrically by means of the cascade connection of the windings and by means of the loading of the vessel propellers. A refinement of this kind is described in the publication "Moderne elektrische Schiffsantriebe [Modern electric vessel propulsion systems]" by H. Mrugowsky, 10th Symposium on Maritime Electronics, Rostock, 2001, Tagungsband Arbeitskreis Energie- und Steuerungstechnik [Energy and control engineering working group seminar volume], pages 63 to 66.

In contrast to the illustration shown in FIG. 2, a vessel propulsion system according to the invention having two electric motors 6*a*, 6*b* could also be provided with a single thermosiphon. In this case, the recess extends continuously between the opposite ends of the shaft 7.

The proposed principle for increasing the degree of efficiency of the electric motor which is used in a vessel propulsion system does not require servicing and can always be employed when the electric motor is connected directly to the vessel propeller. An expected increase in efficiency is in the range of from 1 to 1.5%, as a result of which considerable costs can be saved in the case of large propulsion systems. The vessel propeller which is situated in its cooling medium, the water, provides effective heat dissipation. In addition, bearing temperatures at all the bearing points of the propeller drive train are equalized and reduced for the purpose of cooling the rotor. This increases the service life of these parts which are subject to high levels of wear. Furthermore, a vessel propulsion system according to the invention has the advantage that a reduced winding temperature is achieved, as a result of which low-cost cast resins can be used for the windings.

The invention claimed is:

1. A vessel propulsion system for watercraft, comprising:

at least one vessel propeller with which a drive force for the watercraft can be generated;

a shaft;

an electric motor having a rotor mechanically coupled directly to said at least one vessel propeller by means of said shaft, so that said at least one vessel propeller can be made to perform a corresponding rotation movement as a result of rotation of said rotor; and a thermosiphon disposed in said shaft for cooling said rotor of said electric motor, said thermosiphon having a working medium sealed therein, and said at least one vessel propeller serving as a heat sink for the working medium of said thermosiphon.

2. The vessel propulsion system according to claim 1, wherein said shaft has a recess formed therein, which extends in a longitudinal direction, and forms said thermosiphon in said shaft, it being possible for the working medium to circulate in said recess on account of a change in a state of aggregation between liquid and gaseous states.

3. The vessel propulsion system according to claim 2, wherein said recess extends over an entire width of said rotor of said electric motor.

4. The vessel propulsion system according to claim 3, wherein said electric motor has bearing points and said recess is formed in a region of said bearing points.

5. The vessel propulsion system according to claim 2, wherein said shaft has a central section and at least one end section, which is firmly connected to said central section and to which said at least one vessel propeller is attached, and said recess extending through said central section being of cylindrical design and a portion of said recess extending through said at least one end section being of a conical shape thus defining a conical recess portion.

6. The vessel propulsion system according to claim 5, further comprising a housing part, said electric motor and at least a portion of said central section of said shaft are disposed in a fluid-tight manner in said housing part and said at least one end section being formed outside said housing part.

7. The vessel propulsion system according to claim 6, further comprising an apparatus having a central hub and spokes extending radially from said central hub disposed in said conical recess portion of said at least one end section in order to improve a formation of a condensate film of the working medium on a conical wall of said at least one end section.

8. The vessel propulsion system according to claim 5, wherein said recess has a diameter in said central section with a ratio relative to a diameter of said shaft such that at least one prespecified torque can be transmitted to said at least one vessel propeller.

9. The vessel propulsion system according to claim 2, wherein said shaft having a wall defining said recess, said wall defining said recess is rough.

10. The vessel propulsion system according to claim 2, further comprising a sealing means, and the working medium is inserted into said recess under vacuum and is permanently disposed in said recess without loss by virtue of said sealing means.

11. The vessel propulsion system according to claim 2, wherein the working medium is a refrigerant having an evaporation temperature of less than 100° C.

12. The vessel propulsion system according to claim 1, further comprising a pod, said electric motor is disposed in said pod, said pod being mechanically connected to a hull of the watercraft such that said pod can be rotated in relation to the hull.

13. The vessel propulsion system according to claim 5, wherein in each case one of said end sections is disposed at two opposite ends of said shaft, and said at least one vessel propeller is one of two vessel propellers each being disposed at one of said end sections.

14. The vessel propulsion system according to claim 13, wherein said two vessel propellers, which are disposed on said shaft, are configured in such a way that they are in a form of propellers which operate in an opposite direction in relation to a swirl effect.

15. The vessel propulsion system according to claim 13, wherein said electric motor is one of two electric motors, each of said vessel propellers has an associated one of said two electric motors, and said electric motors acting on said shaft being a common shaft.

16. The vessel propulsion system according to claim 15, wherein said recess is one of two recesses formed in said common shaft each defining one said thermosiphon which are functionally separate from one another, said thermosiphons in each case being associated with one of said electric motors.

17. The vessel propulsion system according to claim 6, wherein said housing part is a housing pod.

18. The vessel propulsion system according to claim 11, wherein the refrigerant is selected from the group consisting of water, FC72, R124a, R600a, and isobutane.

* * * * *